US006439117B1

(12) United States Patent
Dumais et al.

(10) Patent No.: US 6,439,117 B1
(45) Date of Patent: Aug. 27, 2002

(54) PRINTING PRESS WITH MULTI-PLATE PLATE CYLINDER

(75) Inventors: Mark Bernard Dumais, Kennebunk, ME (US); Charles Henry DuFour, Durham, NH (US); Lev Zlatin, Exeter, NH (US); Glenn Alan Guaraldi, Kingston, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/572,361

(22) Filed: May 17, 2000

(51) Int. Cl.[7] ..... B41F 27/00
(52) U.S. Cl. ..... 101/383; 101/382.1; 101/415.1
(58) Field of Search ..... 101/378, 382.1, 101/383, 384, 395, 415.1

(56) References Cited

U.S. PATENT DOCUMENTS 2,708,875 A * 5/1955 Harless ..... 101/378
2,768,578 A * 10/1956 Park et al. ..... 101/415.1
3,335,663 A * 8/1967 Harenza ..... 101/415.1
3,858,512 A * 1/1975 Simeth ..... 101/415.1
5,069,127 A * 12/1991 Iijima et al. ..... 101/415.1
5,284,093 A 2/1994 Guaraldi et al. ..... 101/415.1
5,394,800 A * 3/1995 Soutome et al. ..... 101/378
5,678,487 A 10/1997 Guaraldi et al. ..... 101/415.1

* cited by examiner

*Primary Examiner*—Ren Yan
(74) *Attorney, Agent, or Firm*—Davidson, Davidson & Kappel, LLC

(57) ABSTRACT

A printing press comprising a multi-plate plate cylinder for carrying at least a first printing plate and a second printing plate, the plate cylinder having a cylinder body with an outer surface and a lock-up bar having a retracted position and an extended position, the lock-up bar for fastening both of the first and second plates about the outer surface in the retracted position. A tucker bar is located adjacent the lock-up bar, the tucker bar including at least a first segment for tucking and holding the first printing plate on the plate cylinder and a second segment for tucking and holding the second printing plate on the plate cylinder, the first segment being independently movable with respect to the second segment. Also disclosed is a method including the steps of contacting the first printing plate with an associated first segment of a tucker bar when the common lock-up bar is in an extended position and while the second printing plate is not contacted by an associated second segment of the tucker bar, moving the common lock-up bar to the retracted position so that the first printing plate is fastened and so that an end of the second printing plate is free, and removing the second printing plate from the plate cylinder.

10 Claims, 7 Drawing Sheets

PRINTING PRESS WITH MULTI-PLATE PLATE CYLINDER

BACKGROUND OF THE INVENTION

1. Field of the Invention

The present invention relates generally to printing presses and more particularly to a printing press with a plate cylinder carrying at least two printing plates.

2. Background Information

Printing presses may print a continuous web of material, such as paper. A plate cylinder of the printing press may firmly hold or lock-up a flat printing plate, for example a lithographic printing plate. An image to be printed is formed by ink which is transferred from the printing plate to the paper. In offset printing presses the plate first transfers ink to a blanket and then to the paper.

U.S. Pat. No. 5,284,093 purports to disclose a single-plate plate cylinder with a lock-up mechanism permitting fastening of the single plate.

U.S. Pat. No. 5,678,487 purports to disclose a lock-up mechanism used in conjunction with a tucker bar for fastening a single plate to a single-plate plate cylinder.

These patents however do not address the needs for large newspaper and other presses, where it may be desirable to have more than one printing plate spaced axially about the plate cylinder.

With such presses, each printing plate should able to be registered axially, i.e. positioned properly with respect to the plate cylinder and to each of the other printing plates. The single-plate cylinder devices described in the patents above may register the plate by moving the plate cylinder with respect to the printed material, and thus do not address the problem of independent registration.

In addition, the above-identified patents do not permit for independent plate removal on a multi-plate cylinder.

BRIEF SUMMARY OF THE INVENTION

An object of the present invention is to provide a printing press having a multi-plate plate cylinder which permits for independent removal of each printing plate while the other printing plates remain attached. Another alternate or additional object of the present invention is to provide a printing press with a multi-plate cylinder which permits independent registration of each plate. Yet another alternate or additional object of the present invention is to provide a simple method for providing printing plates to a multi-plate plate cylinder.

The present invention provides a printing press comprising a multi-plate plate cylinder for carrying at least a first printing plate and a second printing plate, the plate cylinder having a cylinder body with an outer surface and a lock-up bar having a retracted position and an extended position, the lock-up bar extending radially beyond the outer surface in the extended position, the lock-up bar for fastening both of the first and second plates about the outer surface in the retracted position. The press also comprises a tucker bar adjacent the lock-up bar, the tucker bar including at least a first segment for tucking and holding the first printing plate on the plate cylinder and a second segment for tucking and holding the second printing plate on the plate cylinder, the first segment being independently movable with respect to the second segment.

By providing a segmented tucker bar with independently movable segments, a single plate of the multi-plate cylinder can be removed when a segment of the tucker bar is retracted. The other plates can remain held by the other segments, which can be in a plate retention position. Thus a single lock-up bar mechanism can be provided for the plate cylinder, which reduces the complexity and cost of the multi-plate plate cylinder, and yet the plates can still be independently removed.

Preferably, the plate cylinder includes at least one register pin associated with each printing plate, so that the printing plate can be properly registered in an axial direction. The present invention, by permitting each plate to be removed thus permitting the register pins to be adjusted, advantageously permits independent registration of each plate.

Advantageously, the pins can be manually adjustable from outside the cylinder when the lock-up bar is in the extended position.

The plate cylinder also advantageously may include at least one spring element for clamping a lead and/or trail end of a printing plate.

The tucker bar may include a plurality of independently-actuable pistons for moving the different segments. The tucker bar preferably acts on a trail end of a printing plate, which is held on the lock up bar. The lead end of the printing plate preferably is held on the plate cylinder body.

The present invention also provides a method for removing printing plates from a multi-plate plate cylinder having a common lock-up bar with a retracted position and an extended position, the plate cylinder for carrying at least a first printing plate and a second printing plate, the method comprising the steps of:

- contacting the first printing plate with an associated first segment of a tucker bar when the common lock-up bar is in an extended position, while the second printing plate is not contacted by an associated second segment of the tucker bar;
- moving the common lock-up bar to the retracted, i.e. locking, position so that the first printing plate is fastened and so that an end of the second printing plate is free; and
- removing the second printing plate from the plate cylinder.

By providing contact to the first printing plate even while the lock-up bar is in the extended position, the first printing plate does not need to release from the plate cylinder. Thus the second printing plate can be removed independently of the first printing plate cylinder, even with a common lock-up bar for both plates.

The present method can further include moving all segments of the tucker bar away from the cylinder surface after the moving of the common lock-up bar step.

The removing step can include rotating the plate cylinder approximately one revolution. A second end of the second printing plate opposite the free end can then be removed. The removal of the second end can be aided by returning the first segment to contact the first printing plate and extending the lock-up bar.

If desired, a register pin associated with the second plate may then be adjusted manually, for example by sliding the register pin axially.

While the first segment holds the first printing plate, a new or the same second printing plate may then be attached to the plate cylinder. The second plate may be attached by inserting a lead edge of the printing plate into a slot formed in the periphery of the plate cylinder. The lead edge can be tucked into the slot with the second segment, and the lock-up bar can be moved to its retracted position, locking the second printing plate lead edge and the first printing plate. All segments of the tucking bar are then moved away from the cylinder and the cylinder is rotated about one revolution so that the new second plate wraps around the cylinder. The lock-up bar is then moved to the extended position, with the tucker bar segment associated with the first printing plate holding the first printing plate in place. The second segment then tucks the trail end of the second plate so the trail end is held by the lock-up bar, which is then retracted. Both the first and second plates are thus firmly held. All segments of the tucker bar are then moved away and the printing press is ready for operation with a new or newly-registered second plate.

Preferably, four plates are carried by the plate cylinder, with each plate being independently replaceable. If, for example, the second plate is to be replaced, the third and fourth plates are held in a similar manner to the first plate.

BRIEF DESCRIPTION OF THE DRAWINGS

An embodiment of the present invention is described below by reference to the following drawings, in which.

DETAILED DESCRIPTION

Figure 1:
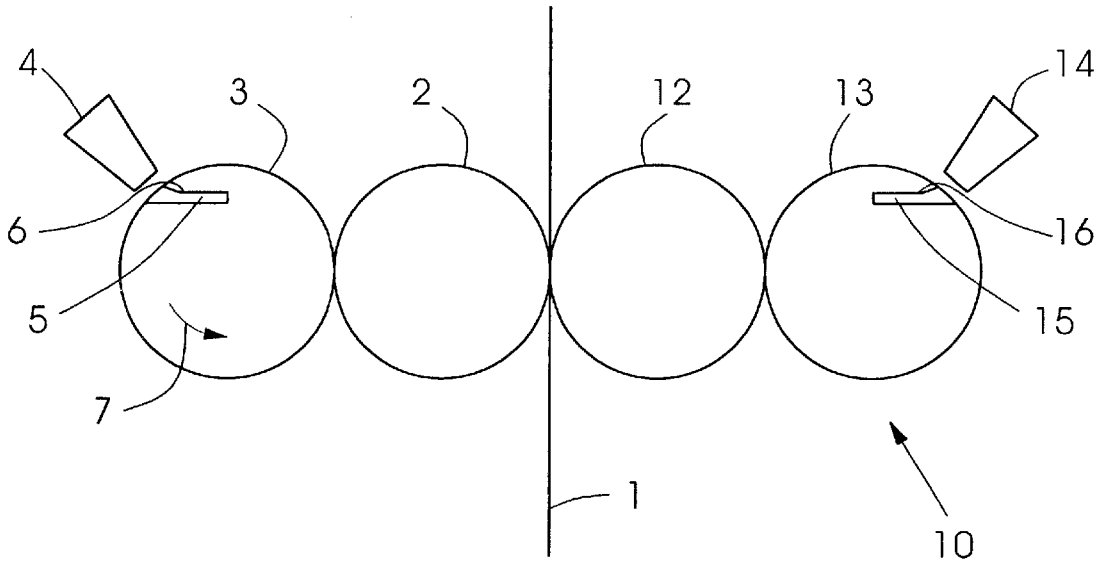
FIG. 1 shows a schematized side view of a lithographic offset printing press according to the present invention.

FIG. 1 shows an offset lithographic printing press 10 for printing a web 1 of material such as paper. Web 1 passes through a nip formed by two blanket cylinders 2, 12, which may have for example, axially removable blankets. A first multi-plate plate cylinder 3 contacts blanket cylinder 2, and a second multi-plate plate cylinder 13 contacts blanket cylinder 12. Web 1 may include a plurality of independent webs spaced axially between the blanket cylinders and may be printed on both sides. Plates on plate cylinder 3 can thus receive ink from an inking unit, with the image being transferred to blanket cylinder 2 and a first side of web 1, and plates on plate cylinder 13 providing an image to a second side of web 1 through blanket cylinder 12. Plate cylinder 3 has a common lock-bar 5 for fastening all of the plates for plate cylinder 3 and plate cylinder 13 has a common lock-up bar 15. A segmented tucker bar 4 provides for tucking the plates into an axially-extending gap 6 in the outer surface of plate cylinder 3, and a segmented tucker bar 14 provides for tucking of plates into an axially extending gap 16 of plate cylinder 13.

Figure 2:
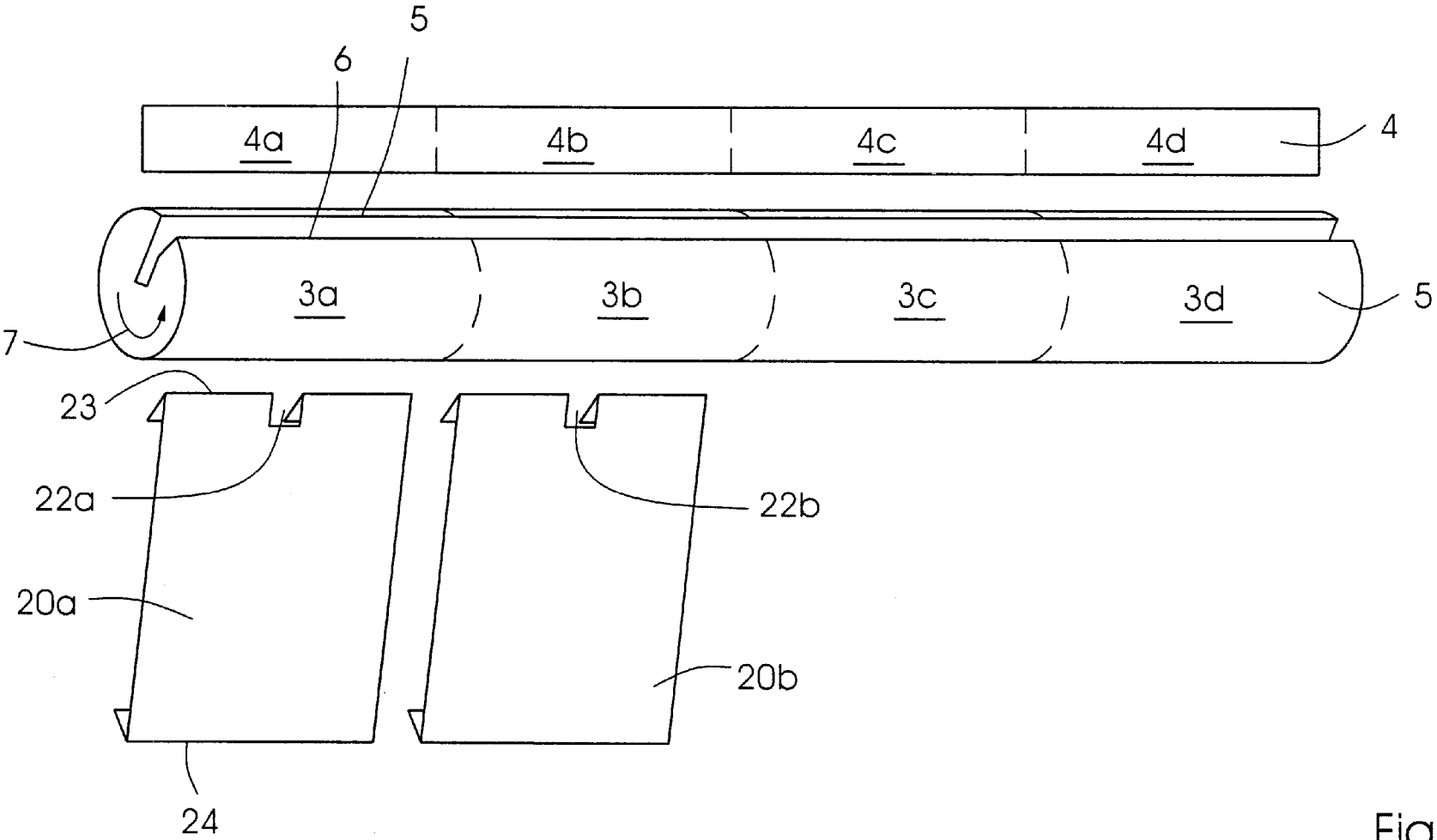
FIG. 2 shows a perspective view of a plate cylinder according to the present invention, with plates not attached.

FIG. 2 shows a perspective view of plate cylinder 3, with common lock-up bar 5 extending axially between four different plate areas 3A, 3B, 3C, and 3D. Plates 20A and 20B can be fastened onto plate areas 3A and 3B, respectively. Two more plates can be provided for sections 3C and 3D as well. Plates 20A and 20B may be registered axially by the interaction of register notches 22A, 22B with register pin located on lock-up bar 5, as will be described. Plate 20A has a lead edge 23 and a trail edge 24, which are bent.

Figure 3:
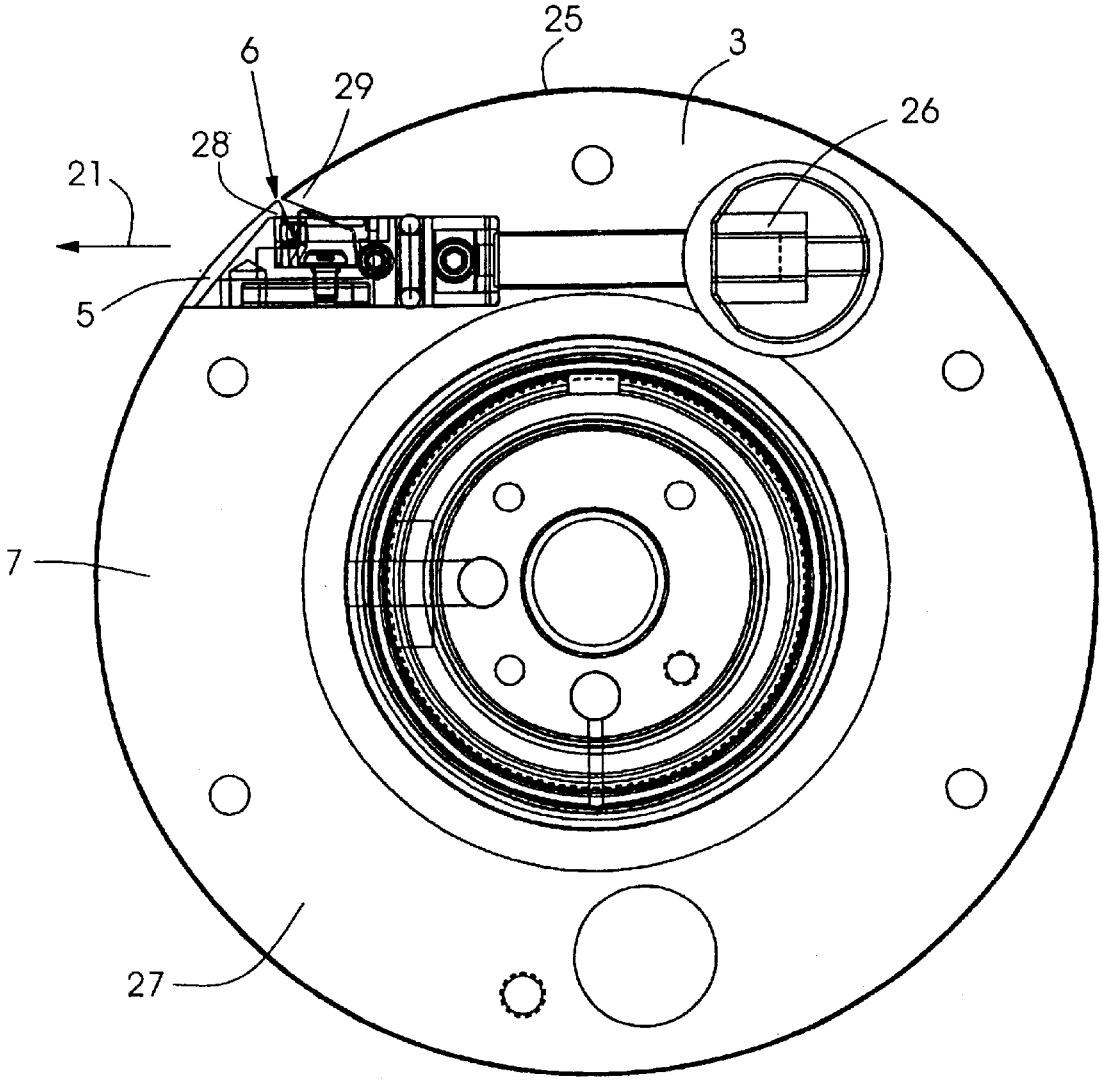
FIG. 3 shows a more detailed side view of the plate cylinder with lock-up bar.

FIG. 3 shows a cross section or end view of cylinder 3 having an outer surface 25. Lock-up bar 5 is movable between a retracted position, as shown, and an extended position, which is achieved by moving lock-up bar 5 in a direction 21. An actuating device 26 can provide for the movement of lock-up bar 5. To permit the plates to be attached or released, lock-up bar 5 is moved from a retracted position to an extended position by moving in the direction of arrow 21, as shown in FIG. 3.

Plates 20A and 20B, and plates for sections 3C and 3D thus can be fastened to cylinder 3 by moving lock-up bar 5 to an extended position so that lock-up bar 5 extends radially beyond the surface 25 of the cylinder 3. The lead edges of the plates 20A, 20B can thus be placed to interact with angled section 29 of a cylinder body 27 of cylinder 3, either with or without the aid of tucker bar 4 as shown in FIG. 2. The lock-up bar 5 can then be retracted and the plate cylinder rotated in the direction of arrow 7, so that the plates 20A, 20B wrap around the plate cylinder 3. Once the trail ends of the plates are located underneath tucker bar 4, the tucker bar 4 can tuck the trail ends of the plates so that the trail ends interact with angled section 28 of bar 5. Thus segments 4A and 4B of tucker bar 4 can move toward the cylinder 3, as can segments 4C and 4D, so that four plates are tucked into the gap 6 in the plate cylinder 3. The lock-up bar 5 is then retracted, so that all four plates are fastened.

Figure 4:
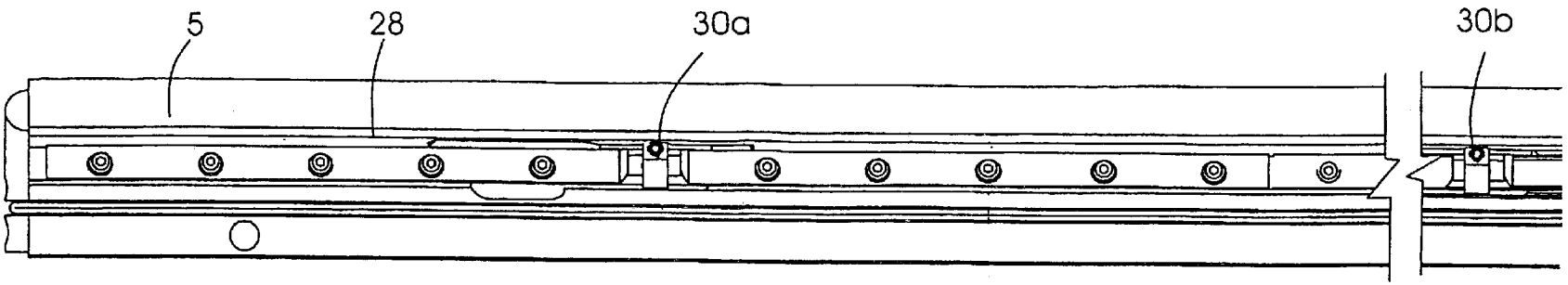
FIG. 4 shows a more detailed view of the lock bar, here removed from the plate cylinder.

So that the plates are properly registered in an axial direction, the lock-up bar includes a register pin for each plate. As shown in FIG. 4, lock-up bar 5 has register pins 30A, 30B to provide proper axial register for the plates. Although the register pins 30A, 30B are on the lock-up bar 5, the pins 30A, 30B extend through the gap to still interact with the notches 22A, 22B, respectively, in the lead edges of the plates 20A, 20B, as shown in FIG. 2. (The trail edge of the slots may also be provided with register notches, or with notches even larger than notches 22A and 22B.)

Register pins 30A, 30B, and ones for sections 3C and 3D, may be manually adjusted when the lock-up bar 5 is extended by sliding the pins axially.

Figure 5:
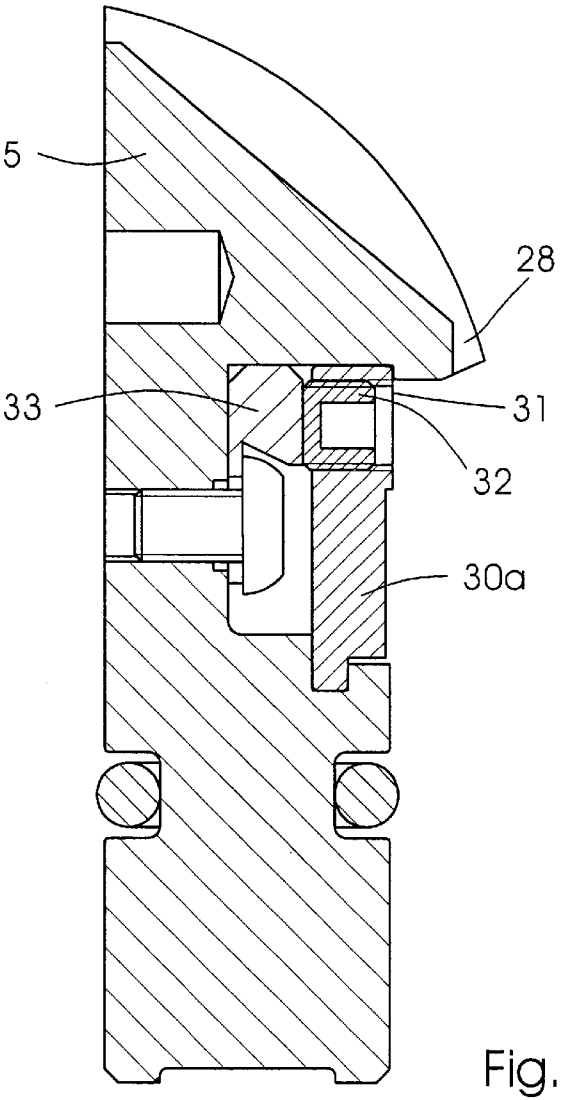
FIG. 5 shows a cross-section view of the lock-up bar of FIG. 4 through section A—A.

FIG. 5 shows a cross-section of bar 5 through register pin 30A, as shown as line A—A in FIG. 4. A screw 32 with external threads can be placed within an interiorly threaded hole 31 of register pin 30A. Screw 32 can be tightened or loosened, for example by an Allen wrench, to act against a friction pad 33 of bar 5. Thus an operator can loosen the register pin 30A to permit the pin to slide axially during the manual adjustment and tighten the pin when finished.

Figure 6:
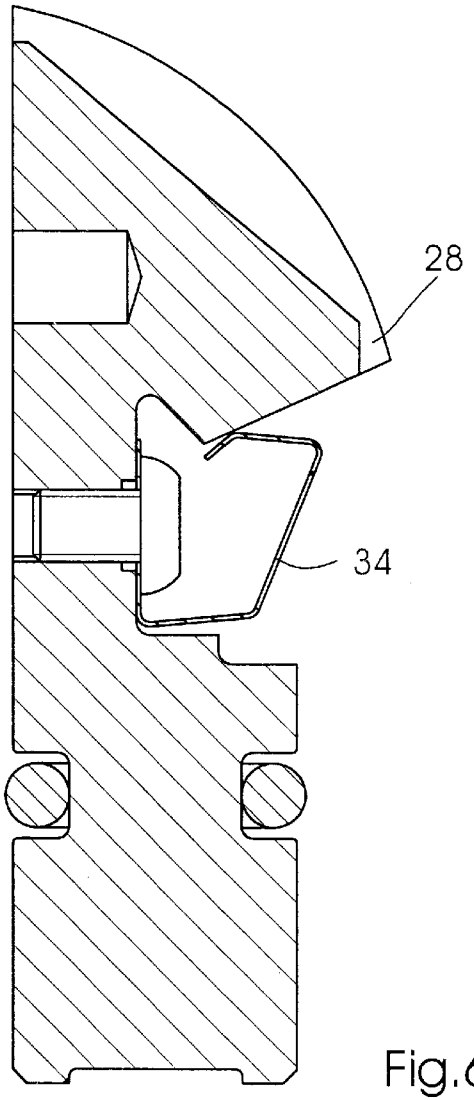
FIG. 6 shows a cross-section view of the lock-up bar of FIG. 4 through section B—B.

FIG. 6 shows a cross-section of bar 5 through section B—B of FIG. 4. A spring 34 can aid in retaining the trail edge of the plates.

Figure 7:
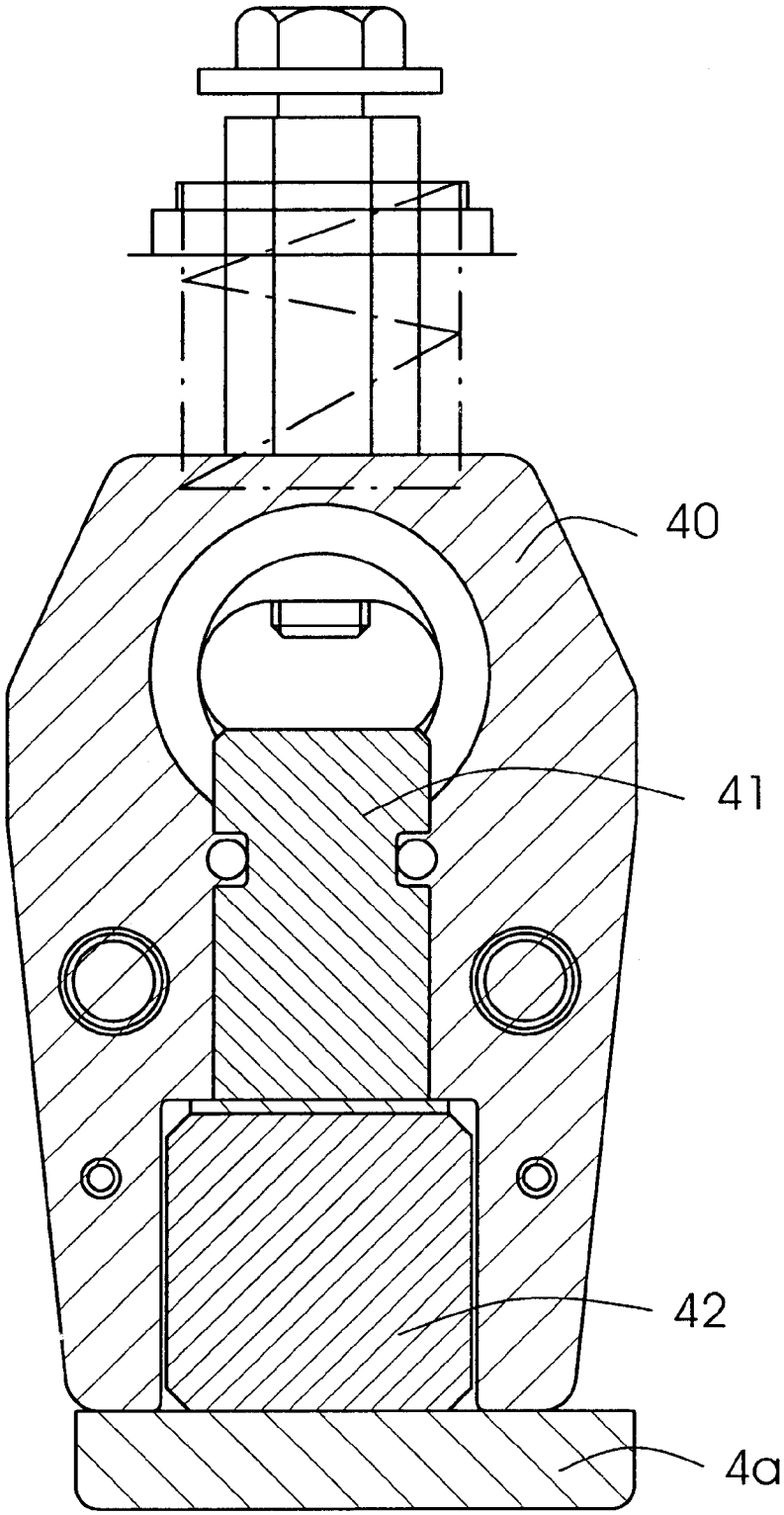
FIG. 7 shows a more detailed side view of the tucker bar of FIG. 1.

FIG. 7 shows in more detail the tucker bar 4 in cross-sectional view. Tucker bar 4 has a housing 40, a piston 41, and a tucker 42 fixedly connected to a tucker segment 4A.

Figure 8:
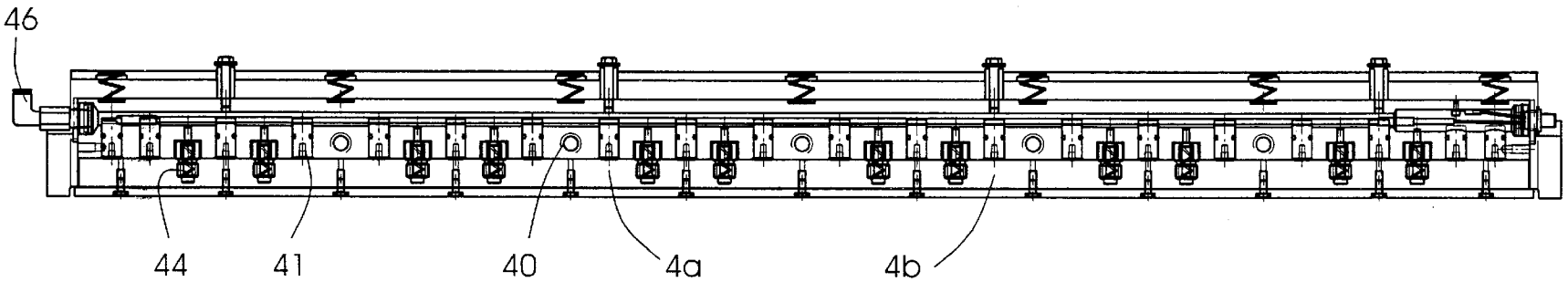
FIG. 8 shows a sectional view of the tucker bar with various segments.

As shown in FIG. 8 (and schematically in FIG. 1), tucker bar 4 has a plurality of segments 4A and 4B, as well as two more segments. Each segment 4A, 4B is connected to a plurality of pistons 41, the pistons for each segment being independently actuable, for example through four air conduits 46. Thus the pistons for each segment can be moved toward the cylinder 3 by air pressure being provided through one of the conduits 46. Springs 44 can act to force the segment 4A away from the cylinder 3. Thus each segment 4A, 4B, 4C, 4D can be operated independently.

The printing press 10 operates as follows if fewer than all of the plates are to be replaced or re-registered. Plates are fastened on sections 3A, 3B, 3C, 3D, respectively. It may be that section 3C needs to be re-registered or that a plate change is desired for that section. The lock-up bar 5 is thus moved to an extended position, while tucker segments 4A, 4B and 4D hold the respective printing plates against the lock-up bar 5. The trail end of the plate on section 3C, not being held by a tucker segment 4C, which remains retracted, releases from bar 5. Bar 5 is then retracted so that plates on sections 3A, 3B, and 3D are locked, as is the lead edge of the plate on section 3C. The tucker segments 4A, 4B and 4D are retracted. The cylinder 3 is then rotated counter to direction 7, so that the trail edge of the plate emerges. After about one revolution, the tucker segments 4A, 4B and 4D are again activated and the bar 5 moved to an extended position. The lead end of the plate for section 3C can then be removed.

At this point the register pin for section 3 can be moved axially, if so desired.

To insert a new plate, the lead end of the new printing plate is inserted into slot 6 while the bar 5 is in an extended position, the lead end interacting with the register pin to insure proper positioning. The tucker segment 4C can aid in this insertion or the insertion can be performed by hand. The lock-up bar 5 is then retracted to hold the lead edge and the other plates, and all of the tucker segments are retracted. The cylinder 3 is then rotated in direction 7 so the plate wraps around the cylinder 3. The tucker segments 4A, 4B and 4D are activated again while the lock-up bar 5 is moved to the extended position so that plates on sections 3A, 3B and 3D do not release. The trail edge of the cylinder is then tucked into gap 6 by tucker segment 4C and the lock-up bar is retracted, thereby locking all four plates in place. The tucker segments are retracted and the cylinder 3 is ready for operation with a new plate on segment 3C.

What is claimed is:

1. A printing press comprising:

a multi-plate plate cylinder for carrying at least a first printing plate and a second printing plate, the plate cylinder having a cylinder body with an outer surface and a lock-up bar having a retracted position and an extended position, the lock-up bar for fastening both of the first and second plates about the outer surface in the retracted position; and a tucker bar adjacent the lock-up bar, the tucker bar including at least a first segment for tucking and holding the first printing plate on the plate cylinder and a second segment for tucking and holding the second printing plate on the plate cylinder, the first segment being independently movable with respect to the second segment.

2. The printing press as recited in claim 1 further comprising a first register device associated with the first printing plate and a second register device associated with the second printing plate, the first and second register devices being movable independently.

3. The printing press as recited in claim 2 wherein the first and second register devices are movable manually.

4. The printing press as recited in claim 1 wherein the lock-up bar extends radially beyond the outer surface in the extended position.

5. The printing press as recited in claim 1 wherein the lock-up bar includes at least one spring element for clamping a lead and/or trail end of at least one of the first printing plate and the second printing plate.

6. The printing press as recited in claim 1 wherein the lock-up bar includes an angled section for contact with a bent section of a printing plate.

7. The printing press as recited in claim 1 wherein the tucker bar includes a plurality of independently-actuable pistons for moving the first and second segments independently.

8. The printing press as recited in claim 1 wherein the tucker bar acts on a trail end of the first and second printing plates.

9. The printing press as recited in claim 1 wherein the tucker bar further includes independently-actuable third and fourth segments.

10. A printing press comprising:

a cylinder for carrying at least a first printing plate and a second printing plate, the cylinder having a cylinder body with an outer surface and a lock-up bar device having a locked position and an unlocked position, the lock-up bar device fastening both of the first and second plates about the outer surface in the locked position; and a tucker bar adjacent the lock-up bar device, the tucker bar including at least a first segment for tucking and holding the first printing plate on the plate cylinder and a second segment for tucking and holding the second printing plate on the plate cylinder, the first segment being independently movable with respect to the second segment.

* * * * *